US008633889B2

(12) United States Patent
Umezaki

(10) Patent No.: US 8,633,889 B2
(45) Date of Patent: Jan. 21, 2014

(54) DISPLAY DEVICE, DRIVING METHOD THEREOF, AND ELECTRONIC APPLIANCE

(75) Inventor: Atsushi Umezaki, Isehara (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 328 days.

(21) Appl. No.: 13/081,530

(22) Filed: Apr. 7, 2011

(65) Prior Publication Data

US 2011/0254826 A1 Oct. 20, 2011

(30) Foreign Application Priority Data

Apr. 15, 2010 (JP) ..... 2010-093959

(51) Int. Cl.
*G09G 3/34* (2006.01)

(52) U.S. Cl.
USPC ..... 345/107

(58) Field of Classification Search
USPC ..... 345/107
See application file for complete search history.

(56) References Cited

U.S. PATENT DOCUMENTS

| | | | | |
|---|---|---|---|---|
| 4,345,249 | A | 8/1982 | Togashi | |
| 4,393,380 | A | 7/1983 | Hosokawa et al. | |
| 5,296,847 | A | 3/1994 | Takeda et al. | |
| 5,448,384 | A | 9/1995 | Uchino et al. | |
| 5,537,129 | A | 7/1996 | Okada et al. | |
| 5,793,346 | A | 8/1998 | Moon | |
| 5,847,687 | A | 12/1998 | Hirakata et al. | |
| 5,867,139 | A | 2/1999 | Tanaka et al. | |
| 5,903,249 | A | 5/1999 | Koyama et al. | |
| 5,926,161 | A | 7/1999 | Furuhashi et al. | |
| 5,926,162 | A | 7/1999 | Wood et al. | |
| 5,945,970 | A | 8/1999 | Moon et al. | |
| 6,005,542 | A | 12/1999 | Yoon | |
| 6,031,514 | A | 2/2000 | Hashimoto et al. | |
| 6,473,077 | B1 * | 10/2002 | Takenaka et al. | 345/209 |
| 6,911,962 | B1 | 6/2005 | Hirakata et al. | |
| 6,987,503 | B2 | 1/2006 | Inoue | |
| 7,336,249 | B2 | 2/2008 | Hirakata et al. | |
| 7,701,435 | B2 | 4/2010 | Hiramatsu | |
| 7,773,069 | B2 | 8/2010 | Miyasaka et al. | |
| 8,264,454 | B2 | 9/2012 | Kim et al. | |
| 2002/0005832 | A1 | 1/2002 | Katase | |
| 2002/0008683 | A1 * | 1/2002 | Makino et al. | 345/88 |
| 2006/0145993 | A1 * | 7/2006 | Kitaoka | 345/94 |
| 2007/0002008 | A1 | 1/2007 | Tam | |
| 2008/0284933 | A1 | 11/2008 | Ito et al. | |
| 2009/0184940 | A1 * | 7/2009 | Silk et al. | 345/173 |

(Continued)

FOREIGN PATENT DOCUMENTS

JP 2002-149115 5/2002

*Primary Examiner* — Kevin M Nguyen
(74) *Attorney, Agent, or Firm* — Eric J. Robinson; Robinson Intellectual Property Law Office, P.C.

(57) ABSTRACT

A driving method of a display device comprising a display area including a plurality of pixels arranged in a matrix, comprising a first step and a second step. In the first step, a first signal is input to each of the plurality of pixels and a first image is displayed on the display area. In the second step, a second signal is input to each of the plurality of pixels; an afterimage that appears on the display area in the first step is erased; a second image is displayed on the display area. The second step is performed after the first step.

28 Claims, 12 Drawing Sheets

(56) References Cited

U.S. PATENT DOCUMENTS

2009/0251456 A1 10/2009 Koyama
2010/0265245 A1 10/2010 Miyasaka et al.
2011/0261042 A1 10/2011 Umezaki

* cited by examiner

DISPLAY DEVICE, DRIVING METHOD THEREOF, AND ELECTRONIC APPLIANCE

BACKGROUND OF THE INVENTION

1. Field of the Invention

The present invention relates to a display device such as a liquid crystal display device or an electrophoretic display device and to the driving method thereof. In addition, the present invention relates to an electronic appliance including the display device such as a liquid crystal display or an electrophoretic display device.

2. Description of the Related Art

Display devices using an electrophoretic element (also called electrophoretic display devices) have attracted attention as display devices capable of being driven at low power. The electrophoretic element is one the principle of which is the movement of charged particles caused by an electric field, and is capable of maintaining a state of the particles for extremely long periods of time as long as an electric field is not generated. Display devices using an electrophoretic element capable of holding an image for a long period of time have been expected to be display devices for displaying a still image such as an electronic book and a poster.

Since display devices using an electrophoretic element are quite promising as display devices with an extremely low power consumption as described above, their various structures have been proposed so far. For example, an active matrix display device in which a transistor is used as a switching element of a pixel has been proposed as in the case of a liquid crystal display device or the like (see Patent Document 1 for example). The display device using an electrophoretic element disclosed in Patent Document 1 employs a technique to rewrite an image in which an image is erased (hereinafter also called the initialization of an image) and then a new image is displayed by setting all the pixel electrodes at the same potential and applying a voltage between a common electrode and a pixel electrode.

REFERENCE

Patent Document

[Patent Document 1] Japanese Published Patent Application No. 2002-149115

SUMMARY OF THE INVENTION

In the conventional technique, however, the initialization of an image is temporarily conducted and then a new image is displayed in rewriting an image, which makes the time needed to rewrite an image long. Further, in rewriting an image, the initialization of an image is conducted, so that the image wholly becomes white or black. This makes the user see flicker in the image. In addition, the initialization of an image is conducted by setting all the pixel electrodes at the same potential despite the fact that the pixels differ in gray level before an image is initialized, thereby causing a new image to have wrong luminance due to the previous image. This wrong luminance is recognized as an afterimage by the user. The conventional technique provides low display quality because of the above factors.

In view of the above problems, an object of one embodiment of the present invention is to improve display quality, to shorten the time needed to rewrite an image, to reduce flicker in an image, and to reduce an afterimage. Note that one embodiment of the present invention does not need to achieve all the objects.

One embodiment of the present invention is a driving method of a display device comprising a display area including a plurality of pixels arranged in a matrix, comprising a first step and a second step. In the first step, a first signal is input to each of the plurality of pixels and a first image is displayed on the display area. In the second step, a second signal is input to each of the plurality of pixels; an afterimage that appears on the display area in the first step is erased; a second image is displayed on the display area. The second step is performed after the first step.

One embodiment of the present invention is a driving method of a display device comprising a display area including a plurality of pixels arranged in a matrix, comprising a first step, a second step, and a third step. In the first step, a first signal is input to each of the plurality of pixels and a first image is displayed on the display area. In the second step, a second signal is input to each of the plurality of pixels; an afterimage that appears on the display area is erased in the first step; a second image is displayed on the display area. In the third step, a third signal is input to each of the plurality of pixels and the second image is retained. The second step is performed after the first step and the third step is performed after the second step.

In a driving method of a display device that is one embodiment of the present invention, a potential of the third signal may be equal to a potential of common electrodes of the plurality of pixels.

In a driving method of a display device that is one embodiment of the present invention, an amplitude voltage of the first signal may be higher than an amplitude voltage of the second signal.

In a driving method of a display device that is one embodiment of the present invention, a time during which the first signal is held in each of the plurality of pixels is longer than a time during which the second signal is held in each of the plurality of pixels.

One embodiment of the present invention is a display device comprising a display area including a plurality of pixels arranged in a matrix and a driver. The driver has a function of inputting a first signal to each of the plurality of pixels and displaying a first image on the display area; and a function of inputting a second signal to each of the plurality of pixels, erasing an afterimage that appears on the first image, and displaying a second image on the display area after displaying the first image on the display area.

One embodiment of the present invention is a display device comprising a display area including a plurality of pixels arranged in a matrix and a driver. The driver has a function of inputting a first signal to each of the plurality of pixels and displaying a first image on the display area; a function of inputting a second signal to each of the plurality of pixels, erasing an afterimage that appears on the first image, and displaying a second image on the display area after displaying the first image on the display area; and a function of inputting a third signal to each of the plurality of pixels and retaining the second image after displaying the second image on the display area.

In a display device that is one embodiment of the present invention, a potential of the third signal may be equal to a potential of common electrodes of the plurality of pixels.

In a display device that is one embodiment of the present invention, an amplitude voltage of the first signal may be higher than an amplitude voltage of the second signal.

In a display device that is one embodiment of the present invention, a time during which the first signal is held in each of the plurality of pixels may be longer than a time during which the second signal is held in each of the plurality of pixels.

Note that, in this specification and the like, one explicitly described as being singular is preferably singular. Such a one, however, is not necessarily singular and can also be plural. Similarly, one explicitly described as being plural is preferably plural. Such a one, however, is not necessarily plural and can also be singular.

Note that, in this specification and the like, the size, layer thickness, signal waveform, and region of each object shown in the drawings and the like of the embodiments are exaggerated for simplicity in some cases. Each object therefore is not necessarily in such scales.

Note that, in this specification and the like, terms such as "first", "second", "third", to "N (N is a natural number)" are used only for preventing confusion between components, and thus do not limit numbers.

According to one embodiment of the present invention, a signal is input to each pixel to erase an afterimage after an image is rewritten. Thus, the time needed to rewrite an image can be shortened. Further, flicker in an image can be reduced. In other words, image quality can be improved.

DETAILED DESCRIPTION OF THE INVENTION

Figure 1:
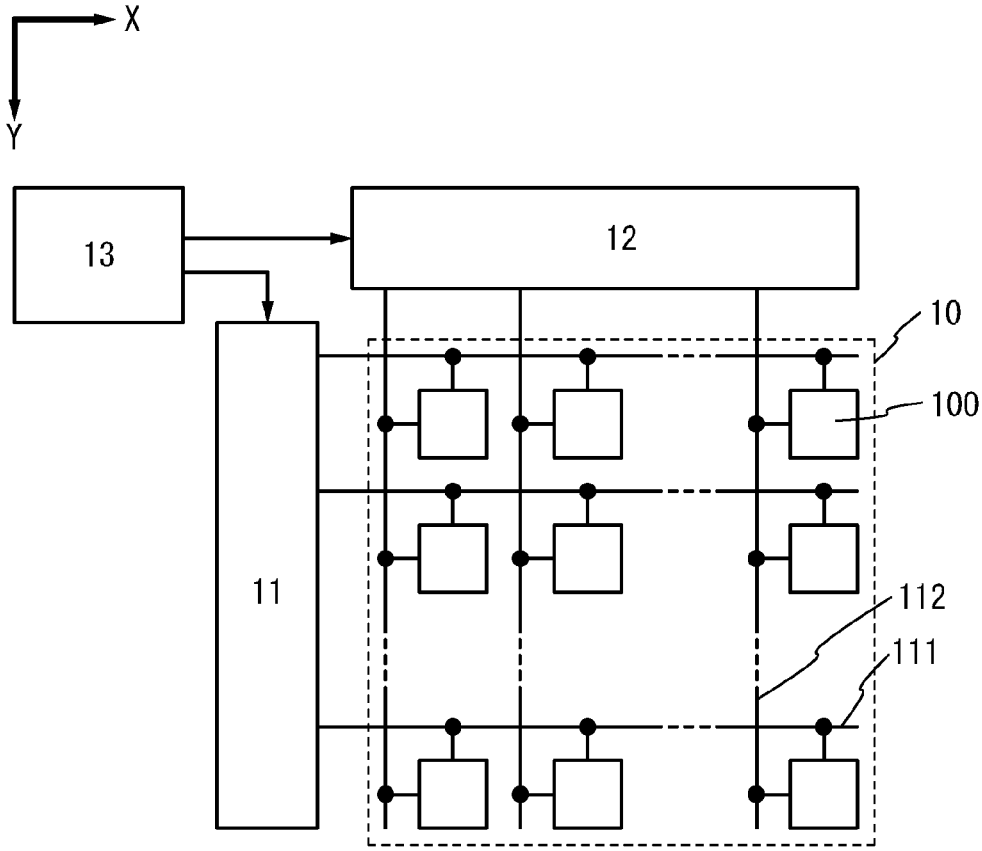
FIG. 1 is a diagram used to describe a display device according to one embodiment of the present invention.

Embodiments of the present invention will be described below in detail with reference to the drawings. Note that the present invention is not necessarily as described below. It will be readily appreciated by those skilled in the art that modes and details of the present invention can be modified in various ways without departing from the spirit and scope of the present invention. Therefore, the present invention should not necessarily be construed as being as described in the embodiments below. Note that, in the structure of the present invention described below, identical objects in all the drawings are denoted by the same reference numeral.

Embodiment 1

In Embodiment 1, a display device that is one embodiment of the present invention and the driving method thereof will be described.

A structural example of the display device of Embodiment 1 will be first described with reference to FIG. 1. A display device shown in FIG. 1 includes a display area 10 (also referred to as a pixel area) in which a plurality of pixels 100 are arranged in a matrix; driver circuits for driving the pixels such as a scan line driver circuit 11 and a signal line driver circuit 12; and a controller 13 for controlling the driver circuits such as the scan line driver circuit 11 and the signal line driver circuit 12.

In the display area 10, n (n is a natural number) gate signal lines 111 (gate signal lines 111_1 to 111_*n*) extended from the scan line driver circuit 11 in the X direction, and m (m is a natural number) source signal lines 112 (source signal lines 112_1 to 112_*m*) extended from the signal line driver circuit 12 in the Y direction are formed. The pixel 100 is formed in each of the portions where the n gate signal lines 111 and the m source signal lines 112 intersect. In other words, the plurality of pixels 100 are in a matrix with n rows and m columns. The gate signal lines 111 are wirings having a function of transferring an output signal of the scan line driver circuit 11 (e.g., a gate signal), and are also called wirings or signal lines. The source signal lines 112 are wirings having a function of transferring an output signal of the signal line driver circuit 12 (e.g., an image signal), and are also called wirings or signal lines.

Note that the display area 10 may include various wirings in addition to the gate signal lines 111 and the source signal lines 112, depending on the configuration of the pixel 100. Examples of the wirings that the display area 10 can include are capacity lines, power supply lines, signal lines, and gate signal lines different from the gate signal lines 111.

Note that a dummy pixel or a dummy wiring (e.g., a dummy gate signal line or a dummy source signal line) may be formed in the display area 10. A dummy pixel or a dummy wiring is preferably formed on the periphery of an area where the plurality of pixels 100 are arranged in a matrix. Forming a dummy pixel or dummy wiring in the display area 10 in this way reduces display defects in the display area 10.

The scan line driver circuit 11 has a function of sequentially selecting the pixels 100 in the first to n-th rows, and is also called a driver circuit or gate driver. The scan line driver circuit 11 includes a shift register circuit, a decoder circuit, or the like. The timing of selecting the pixels 100 is controlled by an operation in which the scan line driver circuit 11 outputs a gate signal (also referred to as a scan signal) to the n gate signal lines 111. To select the pixels 100 in the i-th row (i is included between 1 to n), for example, the scan line driver circuit 11 forces a gate signal output to the i-th gate signal line 111 into a selected state (sets the gate signal one of high and low). Here, if the pixels 100 except the pixels 100 in the i-th row are not supposed to be selected, the scan line driver circuit 11 forces a gate signal output to the gate signal lines 111 except the gate signal line 111 in the i-th row into a non-selected state (sets the gate signal the other of high and low).

Note that the scan line driver circuit 11 may select two or more (e.g., two or three) rows of pixels 100 at the same time. This reduces the frequency of selecting the pixels 100 and reduces power consumption.

Note that the scan line driver circuit 11 can select n rows of pixels 100 row by row in a predetermined order. In this case, the scan line driver circuit 11 preferably includes a decoder.

Note that the scan line driver circuit 11 may select only some of the pixels 100 from the n rows of pixels 100. This is so-called the partial drive. The partial drive performed by the scan line driver circuit 11 can reduce power consumption.

The signal line driver circuit 12 has a function of outputting an image signal to each of the m source signal lines 112, and is also called a driver circuit or source driver. An image signal is a signal based on image data. By inputting an image signal to each of the pixels 100, the gray level of the pixels 100 is controlled, allowing an image based on image data to be displayed on the display area 10. The input of an image signal to each of the pixels 100 is controlled by the signal line driver circuit 12 outputting an image signal to the m source signal lines 112 every time the scan line driver circuit 11 selects the pixel 100.

Note that the signal line driver circuit 12 outputs an image signal to the m source signal lines 112 simultaneously or almost simultaneously. This lengthens the time during which an image signal is in the pixel 100, thereby improving display quality. Note that the signal line driver circuit 12 may sequentially output an image signal to either a single line or a plurality of lines of the m source signal lines 112 at once. In this case, the signal line driver circuit 12 preferably includes a demultiplexer circuit. When the signal line driver circuit 12 includes a demultiplexer circuit, the number of connection points of a substrate over which the display area 10 is formed and an external circuit can be reduced. Consequently, higher yield, cost reduction, and/or higher reliability can be achieved.

The controller 13 has a function of controlling driver circuits such as the scan line driver circuit 11 and the signal line driver circuit 12 in accordance with image data, and is also called a control circuit or a timing controller. Driver circuits such as the scan line driver circuit 11 and the signal line driver circuit 12 are controlled by an operation in which the controller 13 supplies various control signals to driver circuits such as the scan line driver circuit 11 and the signal line driver circuit 12. For example, the controller 13 supplies a control signal such as a vertical synchronization signal, a clock signal, or a pulse width control signal to the scan line driver circuit 11. For example, the controller 13 supplies an image signal and a control signal such as a horizontal synchronization signal, a clock signal, or a latch signal to the signal line driver circuit 12.

Note that the controller 13 may supply not only a signal but a voltage to driver circuits such as the scan line driver circuit 11 and the signal line driver circuit 12. In this case, the controller 13 includes a power supply circuit such as DCDC converter and/or a regulator circuit. It is possible to achieve a reduction in the number of components, cost reduction, and/or higher yield by forming the power supply circuit and the circuit for supplying a signal to driver circuits such as the scan line driver circuit 11 and the signal line driver circuit 12, over the same substrate (on one chip).

Figure 2A:
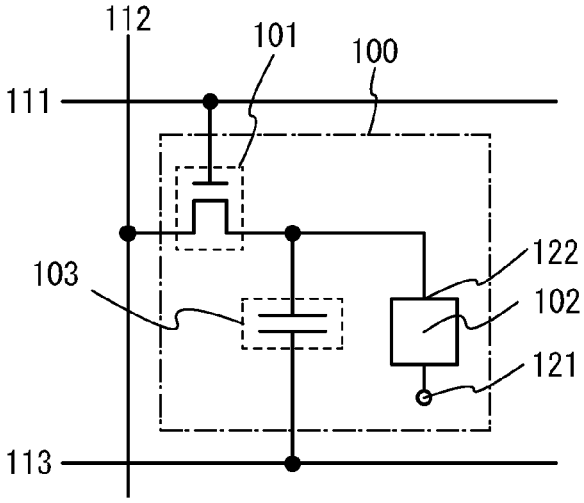
FIGS. 2A and 2B are diagrams used to describe a display device according to one embodiment of the present invention.

Next, an example of the circuit configuration of the pixel 100 will be described with reference to FIG. 2A. The pixel 100 includes a transistor 101, a display element 102, and a capacitor 103. The display element 102 is sandwiched between a common electrode 121 and a pixel electrode 122 (also referred to as an electrode). A first terminal (one of a source electrode and a drain electrode) of the transistor 101 is electrically connected to a source signal line 112. A second terminal (the other of the source electrode and the drain electrode) of the transistor 101 is electrically connected to a pixel electrode 122. A gate of the transistor 101 is electrically connected to a gate line 111. A first electrode of the capacitor 103 is electrically connected to a capacity line 113. A second electrode of the capacitor 103 is electrically connected to the pixel electrode 122.

The capacity line 113 is electrically connected to the first electrodes of the capacitors 103 in all the pixels 100. A predetermined voltage is applied to the capacity line 113. The capacity line 113 is also called a power supply line. The same voltage as that applied to the common electrode 121 or a voltage with the same value as a voltage applied to the common electrode 121, in particular, is preferably applied to the capacity line 113. This reduces the number of the kinds of power source voltage supplied to the display device.

The common electrode 121 is common to the display elements 102 in all the pixels 100, and is also called an electrode, a counter electrode, a common electrode, or a cathode. A predetermined voltage (also called a common voltage) is supplied to the common electrode 121. Note that a voltage applied to the common electrode 121 may be varied. This reduces the amplitude voltage of an image signal, leading to a reduction in power consumption. A display element having memory properties needs a high drive voltage compared to a TN liquid crystal element which is in common use for example, thereby increasing a voltage applied to a transistor. The transistor may accordingly degrade. However it is possible to reduce a voltage applied to the transistor by varying a voltage applied to the common electrode 121 and thus reducing the amplitude voltage of an image signal as described above. This can suppress the degradation of the transistor.

Note that when a voltage applied to the common electrode 121 is varied, a voltage applied to the capacity line 113 may be also varied at the same time. In other words, the common electrode 121 and the capacity line 113 may be at the same or approximately the same potential. Thus, even when a voltage applied to the common electrode 121 is varied, a voltage applied to the display element 102 can remain unchanged. As a result, the gray level of the display element 102 can be maintained, preventing a decrease in display quality.

The transistor 101 is a switch having a function of controlling an electrical continuity between the source signal line 112 and the pixel electrode 122, and is also called a selecting transistor. Either an n-channel transistor or a p-channel transistor may be used as the transistor 101. When an n-channel transistor is used as the transistor 101, the transistor 101 is turned on when the gate signal is brought high, thereby selecting the pixel 100; while the transistor 101 is turned off when the gate signal is brought low, thereby deselecting the pixel 100. In contrast, when a p-channel transistor is used as the transistor 101, the transistor 101 is turned on when the gate signal is brought low, thereby selecting the pixel 100; while the transistor 101 is turned off when the gate signal is brought high, thereby deselecting the pixel 100.

Note that when an n-channel transistor is used as the transistor 101, a transistor using amorphous silicon, microcrystalline silicon, or an oxide semiconductor; an organic transistor; or the like can be used as the transistor 101. It is possible to reduce the off-state current of the transistor 101 by using a transistor using an oxide semiconductor in particular as the transistor 101, thereby allowing the capacitor 103 to be omitted or downscaled and improving the withstand voltage of the transistor 101. The withstand voltage of the transistor 101 is preferably increased because a display element with memory properties such as an electrophoretic element needs a high drive voltage.

Note that the use of a transistor using amorphous silicon, microcrystalline silicon, or an oxide semiconductor as the transistor 101 reduces the number of fabrication steps compared to the use of a transistor using polycrystalline silicon, and therefore achieves a reduction in manufacturing cost, higher yield, and/or higher reliability.

The capacitor 103 has a function of keeping the potential of the pixel electrode 122 constant, and is also called a storage capacitor. Specifically, the capacitor 103 holds a potential difference between the capacity line 113 and the pixel electrode 122 or charge generated by this potential difference. Thus, the potential of the pixel electrode 122 can be kept constant, thereby improving display quality. Further, the time during which an image can be retained can be made longer.

Note that the first electrode of the capacitor 103 may be connected to the gate line 111 in another row (e.g., the previous row). This omits the capacity line 113 and improves aperture ratio.

The display element 102 has memory properties. Examples of the display element 102 or the driving method of the display element 102 are the microcapsule electrophoretic method, microcup electrophoretic method, horizontal electrophoretic method, vertical electrophoretic method, twisting ball method, liquid powder method, electronic liquid powder (registered trademark) method, cholesteric liquid crystal element, chiral nematic liquid crystal element, anti-ferroelectric liquid crystal element, polymer dispersed liquid crystal element, charged toner, electrowetting method, electrochromism method, and electrodeposition method.

Figure 2B:
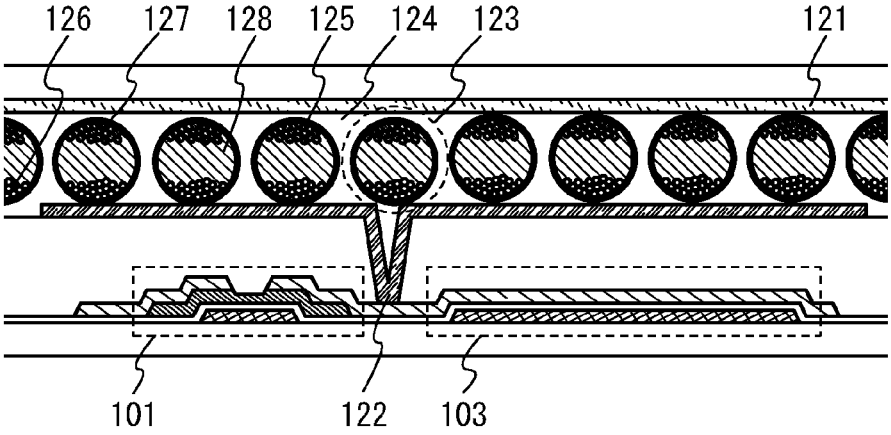

Next, an example of the cross-sectional structure of the pixel 100 that uses a display element employing a microcapsule electrophoretic method as its display element 102 will be described with reference to FIG. 2B. In the display element 102, a plurality of microcapsules 123 are placed between the common electrode 121 and the pixel electrode 122. The microcapsules 123 are fixed by a resin 124. The resin 124 functions as a binder and has light-transmitting properties. A space formed by the common electrode 121, the pixel electrode 122, and the microcapsules 123 may be filled with a gas such as air or an inert gas. In this case, a layer containing glue, adhesive, or the like is preferably formed on one or both of the common electrode 121 and the pixel electrode 122 to fix the microcapsules 123.

The microcapsule 123 includes a film 125, white particles 126 charged either positively or negatively, black particles 127 charged with the opposite polarity to that of the white particles, and dispersion liquid 128 with light-transmitting properties. The white particles 126, the black particles 127, and the dispersion liquid 128 are enclosed with the film 125.

Note that the particles enclosed with the film 125 may be blue, green, or red. Alternatively, the dispersion liquid 128 may be blue, green, red, or the like. Alternatively, both particles enclosed with the film 125 and the dispersion liquid 128 may be blue, green, red, or the like. Thus, color images can be displayed.

Note that three or more kinds of particles may be enclosed with the film 125. One kind of particles preferably has a different charge density from another.

In the above-described display element 102, the white particles 126 and the black particles 127 are moved by making a potential difference between the common electrode 121 and the pixel electrode 122. The gray level of the display element 102 is controlled by utilizing this movement of the particles. For example, the display element 102 has a lighter shade of gray (e.g., white) if the white particles 126 move to the vicinity of the common electrode 121 when seen from the common electrode 121 side. In contrast, the display element 102 has a darker shade of gray (e.g., black) if the black particles 127 move to the vicinity of the common electrode 121 when seen from the common electrode 121 side.

On the other hand, when the common electrode 121 and the pixel electrode 122 are at the same potential or when a potential difference between the common electrode 121 and the pixel electrode 122 is equal or below the threshold voltage of the display element 102, the white particles 126 and the black particles 127 stop moving. The gray level of the display element 102 can be maintained by utilizing this. For example, the lighter shade of gray of the display element 102 can be maintained by stopping the movement of the white particles 126 and the black particles 127 while the white particles 126 accumulate in the vicinity of the common electrode 121 when seen from the common electrode 121 side. In contrast, the darker shade of gray of the display element 102 can be maintained by stopping the movement of the white particles 126 and the black particles 127 while the black particles 127 accumulate in the vicinity of the common electrode 121 when seen from the common electrode 121 side.

Next, the operation of the display device of Embodiment 1 will be roughly described below.

The gray level of the display element 102 is controlled by controlling the potential of the common electrode 121 and the potential of the pixel electrode 122 and thus applying a voltage to the display element 102. The potential of the common electrode 121 is controlled by applying the common voltage to the common electrode 121. The potential of the pixel electrode 122 is controlled by controlling a signal input to the source signal line 112 (an output signal of the signal line driver circuit 12). Note that when the transistor 101 is turned on, a signal on the source signal line 112 is input to the pixel 100.

Note that the gray level of the display element 102 can be controlled by controlling one or more of the following matters: the magnitude of a voltage applied to the display element 102; the length of time during which a voltage whose value is higher than the threshold voltage of the display element 102 is applied to the display element 102; and the polarity of a voltage applied to the display element 102.

Note that the gray level of the display element 102 is maintained by setting the potential of the common electrode 121 equal to the potential of the pixel electrode 122, or by setting these potentials equal or below the threshold voltage of the display element 102.

Figure 3A:
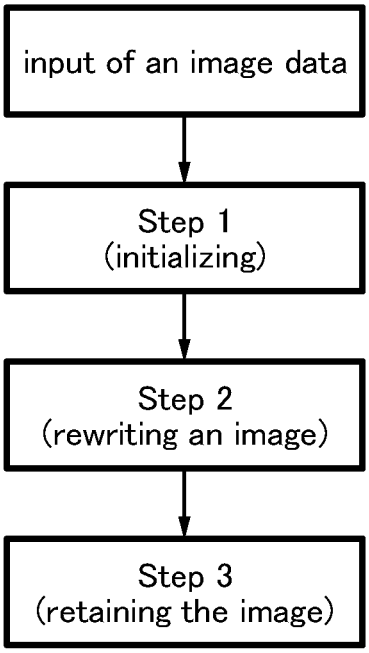
FIGS. 3A to 3D are diagrams used to describe a display device according to one embodiment of the present invention.
Figure 3C:
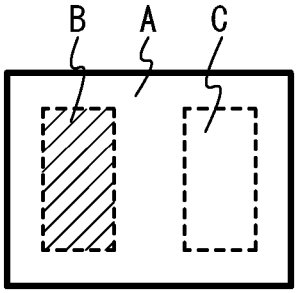
Figure 3D:
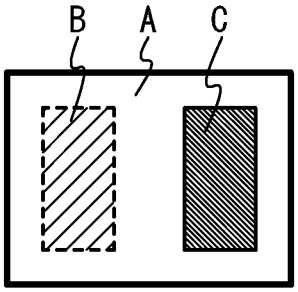
Figure 3B:
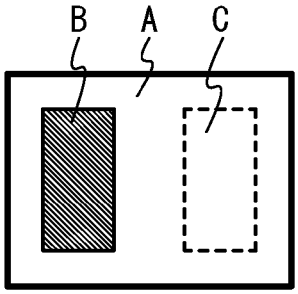

Before describing the operation of the display device of this embodiment in detail, the operation of a comparative display device will now be described with reference to FIGS. 3A to 3D. FIG. 3A is an example of a flow chart used to describe an operation of the comparative display device conducted to rewrite an image. For illustrative purposes, the operation of the comparative display device can be divided into a step of initializing the image; a step of rewriting an image; and a step of retaining the image. FIGS. 3B to 3D each show an example of an image displayed on the display area 10 of the comparative display device when an image is rewritten. Note that an image that is firstly displayed on the display area 10 is called an old image, and an image that is subsequently displayed on the display area 10 a new image. Note that the display area 10 is divided into a region A, a region B, and a region C for illustrative purposes. The region A remains white (also called a first shade of gray) even after the image changes from the old image to the new image. The region B turns from black (also called a second shade of gray) to white when the image changes from the old image to the new image. The region C turns from white to black when the image changes from the old image to the new image.

Suppose, for convenience, that the user views the display device from the common electrode 121 side and the user therefore sees white when the white particles 126 accumulate on the common electrode 121 side, and black when the black particles 127 accumulate on the common electrode 121 side.

Suppose, for convenience, that the white particles 126 move to the pixel electrode 122 side, while the black particles 127 move to the common electrode 121 side when the potential of the pixel electrode 122 is higher than that of the common electrode 121; on the other hand, the white particles 126 move to the common electrode 121 side, while the black particles 127 move to the pixel electrode 122 side when the potential of the pixel electrode 122 is lower than that of the common electrode 121.

The old image is displayed on the display area 10 at first. The region A, the region B, and the region C are accordingly white, black, and white, respectively as shown in FIG. 3B. In other words, the white particles 126 accumulate on the common electrode 121 side in the region A and the region C, while the black particles 127 accumulate on the common electrode 121 side in the region B.

Next, image data is input to the display device. Then, in a step 1, the display area 10 is initialized to be wholly white and the old image is erased. Consequently, as shown in FIG. 3C, the region A remains white; the region B turns from black to white; the region C remains white. The display area 10 is initialized by setting, in all the pixels 100, the potential of the pixel electrodes 122 lower than that of the common electrodes 121 and thus making the white particles 126 move to the common electrodes 121 side. A difference, however, occurs between the gray scale of the region A and region C and that of the region B in FIG. 3C. This is due to the fact that the same voltage is applied to the display elements 102 in all the pixels 100 even though the region A and the region C differ from the region B in distribution of the white particles 126 and black particles 127.

In the subsequent step 2, the new image is displayed on the display area 10. Consequently, the region A remains white; the region B remains white; the region C turns from white to black as shown in FIG. 3D. The gray level of the region A and the region B is controlled by setting, in the pixels 100 of the region A and region B, the potential of the pixel electrodes 122 equal to that of the common electrodes 121, and thus preventing the particles from moving or thus stopping the movement of the particles. The gray level of the region C is controlled by setting, in the pixels 100 of the region C, the potential of the pixel electrodes 122 higher than that of the common electrodes 121, and thus making the black particles 127 move to the common electrode 121 side. The particles however do not move in the pixels 100 of the region A and the region B as in FIG. 3C, so that a difference in gray level still lies between the region A and the region B.

In the subsequent step 3, the image displayed on the display area 10 is retained. Consequently, the region A remains white; the region B remains white; the region C remains black. The image is retained by setting, in all the pixels 100, the potential of the pixel electrodes 122 equal to that of the common electrodes 121, and thus preventing the particles from moving or thus stopping the movement of the particles. Naturally, the particles do not move in all the pixels 100, so that a difference in gray level still lies between the region A and the region B as in FIG. 3D.

As described above, in the comparative display device, the new image is displayed on the display area after the display area is initialized. Consequently, the time lapse after the erase of the old image and before the display of the new image on the display area 10 is lengthened. Further, the image wholly turns white or black while the image changes from the old image to the new image because of the initialization of the display area 10. This makes the user see flicker in the image, which decreases display quality. Moreover, the new image is given an incorrect gray level, that is, a gray level for the old image even with the initialization of the display area 10. This makes the user see an afterimage, which decreases display quality.

Figure 4A:
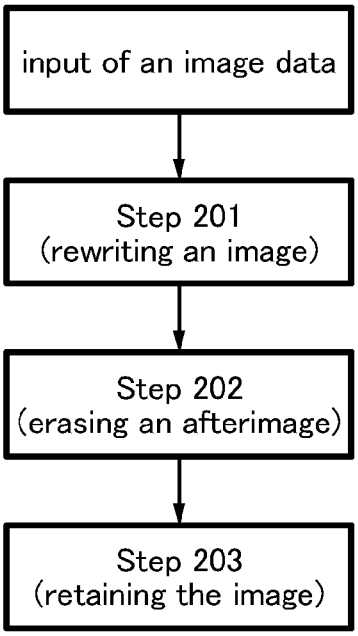
FIGS. 4A to 4D are diagrams used to describe a display device according to one embodiment of the present invention.
Figure 4B:
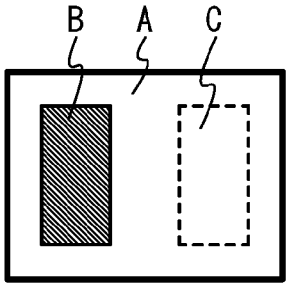
Figure 4C:
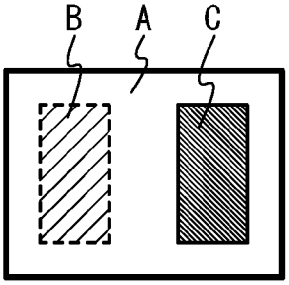
Figure 4D:
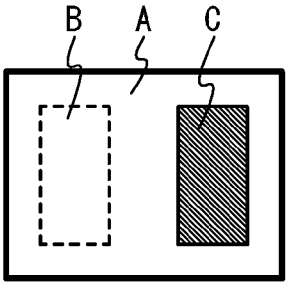
Figure 5:
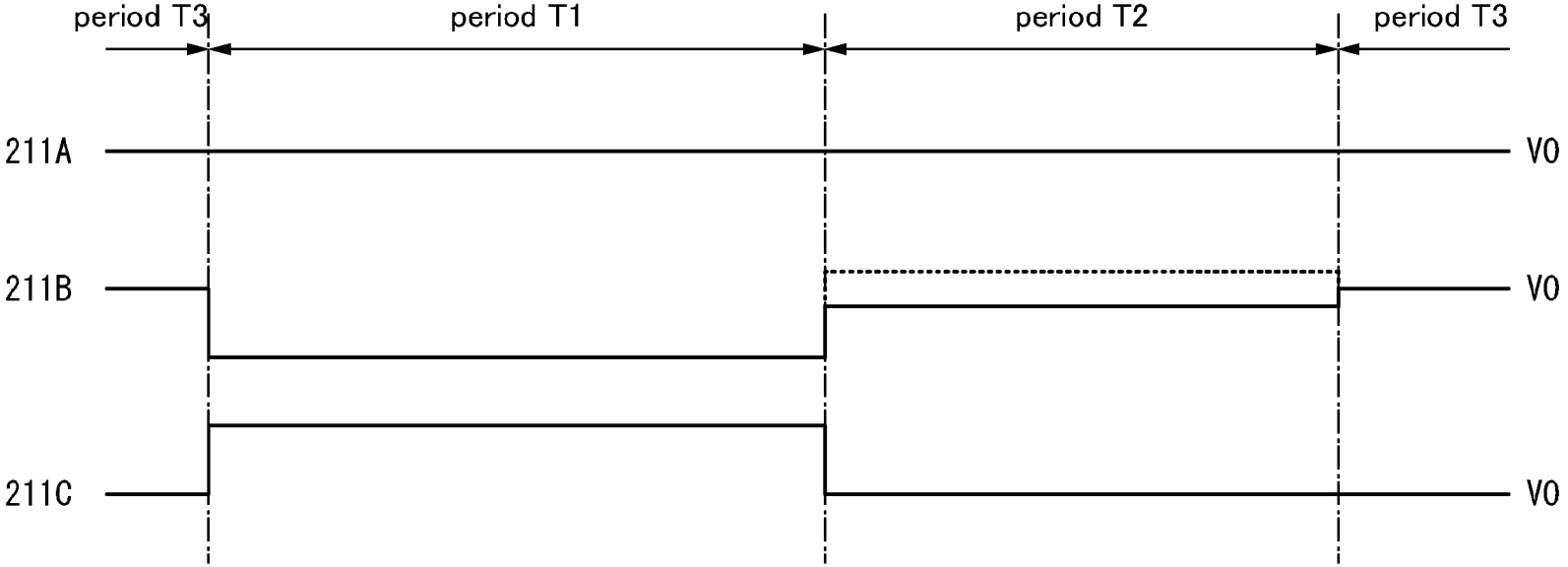
FIG. 5 is a diagram used to describe a display device according to one embodiment of the present invention.

Next, an operation of the display device of Embodiment 1 will be described in detail with reference to FIGS. 4A to 4D and FIG. 5 in terms of its advantages over a conventional technique and the like. FIG. 4A is an example of a flow chart used to describe an operation of the display device of Embodiment 1 conducted to rewrite an image. For illustrative purposes, the operation of the display device of Embodiment 1 can be divided into a step of rewriting an image; a step of erasing the afterimage; and a step of retaining the image. FIGS. 4B to 4D each show an example of an image displayed on the display area 10 of the display device of Embodiment 1 when an image is rewritten. FIG. 5 is an example of a timing diagram used to describe the operation of the display device of Embodiment 1 conducted to rewrite an image. The operation of the display device of Embodiment 1 can be described with a period T1 during which an image is rewritten (a rewrite period); a period T2 during which the afterimage is erased (an erase period); and a period T3 during which the image is retained (a retention period). The period T1 is a period during which a step 201 shown in FIG. 4A is performed. The period T2 is a period during which a step 202 shown in FIG. 4A is performed. The period T3 is a period during which a step 203 shown in FIG. 4A is performed.

Suppose, for convenience, that the potential of the common electrode 121 is at a predetermined value (shown as V0). In FIG. 5, the potential of the pixel electrodes 122 of the pixels 100 included in the region A is shown as a potential 211A; the potential of the pixel electrodes 122 of the pixels 100 included in the region B is shown as a potential 211B; the potential of the pixel electrodes 122 of the pixels 100 included in the region C is shown as a potential 211C.

The old image is displayed on the display area 10 at first. The region A, the region B, and the region C are accordingly white, black, and white, respectively as shown in FIG. 4B. In other words, the white particles 126 accumulate on the common electrode 121 side in the region A and the region C, while the black particles 127 accumulate on the common electrode 121 side in the region B.

Next, image data of the new image is input to the display device. Then, in the step 201 shown in FIG. 4A i.e., in the period T1 shown in FIG. 5, an image signal (also called a first signal) based on the image data of the new image is input to each pixel 100, so that the new image is displayed on the display area 10. Consequently, the region A remains white; the region B turns from black to white; the region C turns from white to black as shown in FIG. 4C.

The gray level of the region A is controlled by, as shown in FIG. 5, inputting an image signal whose potential is equal to the potential V0 to the pixels 100 in the region A and setting the potential of the pixel electrodes 122 equal to the potential V0. Thus, the movement of the particles in the region A can be stopped, thereby keeping the region A white.

Alternatively, the gray level of the region A may be controlled by inputting an image signal having a potential that is lower than the potential V0 to the pixels 100 in the region A and setting the potential of the pixel electrodes 122 lower than the potential V0.

The gray level of the region B is controlled by, as shown in FIG. 5, inputting an image signal whose potential is lower than the potential V0 to the pixels 100 in the region B and setting the potential of the pixel electrodes 122 lower than the potential V0. Thus, in the region B, the white particles 126 can move to the common electrode 121 side, thereby making the region B close to white.

The gray level of the region C is controlled by, as shown in FIG. 5, inputting an image signal whose potential is higher than the potential V0 to the pixels 100 in the region C and setting the potential of the pixel electrodes 122 higher than the potential V0. Thus, in the region C, the black particles 127 can move to the common electrode 121 side, thereby making the region C close to black.

The new image can be displayed on the display area 10 by the operation performed in the step 201 i.e., in the period T1. However, as shown in FIG. 4C, there is a difference between the gray level of the region A and that of the region B at the end of the step 201 (the end of the period T1). In other words, the old image is displayed on the display area 10 as an afterimage. Note that an image displayed in the step 201 i.e., in the period T1 is also called a first image.

In order that the region A, the region B, or the region C may have a middle shade of gray, it is necessary to control the magnitude of a voltage applied to the display element 102.

In the subsequent step 202 shown in FIG. 4A i.e., in the period T2 shown in FIG. 5, an erase signal that is used to erase an afterimage (also called a second signal) is input to each pixel 100, so that an afterimage in the image displayed on the display area 10 is erased. Specifically, the gray level of the region B is changed to eliminate or reduce the difference between the gray level of the region A and that of the region B.

The gray level of the region A is controlled by, as shown in FIG. 5, inputting an erase signal whose potential is equal to the potential V0 to the pixels 100 in the region A and setting the potential of the pixel electrodes 122 equal to the potential V0. Thus, the movement of the particles in the region A can be stopped, thereby maintaining the gray level of the region A.

The gray level of the region B is controlled by, as shown in FIG. 5, inputting either an erase signal whose potential is lower than the potential V0 (shown by a solid line) or an erase signal whose potential is higher than the potential V0 (shown by a dotted line) to the pixels 100 in the region B and controlling the potential of the pixel electrodes 122. Specifically, when the region B has a darker shade of gray than the region A at the end of the step 201 i.e., the end of the period T1, the gray level of the region B is controlled by inputting an erase signal whose potential is lower than the potential V0 to the pixels in the region B and setting the potential of the pixel electrodes 122 lower than the potential V0. Thus, in the region B, the white particles 126 move to the common electrode 121 side, allowing the region B to have a lighter shade of gray than at the end of the step 201. Consequently, a difference between the gray level of the region A and that of the region B is eliminated or reduced. In contrast, when the gray level of the region B has a lighter shade of gray than the region A at the end of the step 201 i.e., the end of the period T1, the gray level of the region B is controlled by inputting an erase signal whose potential is higher than the potential V0 to the pixels in the region B and setting the potential of the pixel electrodes 122 higher than the potential V0. Thus, in the region B, the black particles 127 move to the common electrode 121 side, allowing the region B to have a darker shade of gray than at the end of the step 201. Consequently, a difference between the gray level of the region A and that of the region B is eliminated or reduced.

The gray level of the region C is controlled by, as shown in FIG. 5, inputting an erase signal whose potential is equal to the potential V0 to the pixels 100 in the region A and setting the potential of the pixel electrodes 122 equal to the potential V0. Thus, the movement of the particles in the region C can be stopped, thereby maintaining the gray level of the region C.

An afterimage that appears in the image (the first image) displayed on the display area 10 in the step 201 can be erased by the operation performed in the step 202 i.e., in the period T2. Note that an image displayed in the step 202 i.e., in the period T2 is also called a second image.

Note that what is done in the step 202 i.e., in the period T2 is only to eliminate or reduce a difference in gray level, so that the movement of the particles in the step 202 i.e., in the period T2 is smaller than that in the step 201 i.e., in the period T1. For this reason, the time during which the step 202 is taken i.e., the length of the period T2 is preferably shorter than the time during which the step 201 is taken i.e., the length of the period T1. In other words, the time during which the pixel holds an erase signal is preferably shorter than the time during which the pixel holds an image signal.

Note that the absolute value of a voltage applied to a display element 102 in the step 202 i.e., in the period T2 is preferably lower than that of a voltage applied to the display element 102 in the step 201 i.e., in the period T1. In other words, the amplitude voltage of an erase signal is preferably lower than that of an image signal. Thus, power consumption can be reduced.

Note that in the step 202 i.e., in the period T2, a difference between the gray level of the region A and that of the region B may be eliminated or reduced by making the gray level of the region A close to that of the region B. In this case, the gray level of the region A is controlled by inputting either an erase signal whose potential is lower than the potential V0 or an erase signal whose potential is higher than the potential V0 to the pixels 100 in the region A.

In the subsequent step 203 shown in FIG. 4A i.e., the period T3 shown in FIG. 5, a retention signal (also called a third signal) used to retain an image is input to each pixel 100, so that an image displayed on the display area 10 (the image shown in FIG. 4D) can be retained. Consequently, the region A remains white; the region B remains white; the region C remains black.

The gray level of each region is controlled by, as shown in FIG. 5, inputting a retention signal whose potential is equal to the potential V0 to the pixels 100 in each region and setting the potential of the pixel electrodes 122 equal to the potential V0. Thus, the movement of the particles in each region can be stopped, thereby maintaining the gray level of each region. Consequently, in the step 203 i.e., in the period T3, the image (the second image) displayed on the display area 10 in the step 203 can be kept being displayed on the display area 10.

In the display device of Embodiment 1, an afterimage is erased after the new image is displayed on the display area 10 as described above. For this reason, the display device of Embodiment 1 can make the time lapse after the input of image data based on the new image and before the display of the new image on the display area 10 shorter than the comparative display device. In other words, the display device of Embodiment 1 can increase the screen refresh rate.

Further, in the display device of Embodiment 1, initialization is not performed before the new image is displayed on the display area 10. Consequently, unlike in the comparative display device, display quality does not decrease because of flicker in an image. In other words, display quality can be improved.

Next, the driving method of the display device that is different from the driving method that has been described with reference to FIG. 5 will be described with reference to a timing diagram of FIG. 6. The driving method of the display device described with reference to FIG. 6 is different from the driving method that has been described with reference to FIG. 5 in controlling the gray level of each region by controlling the time during which a voltage is applied to the display elements 102.

Figure 6:
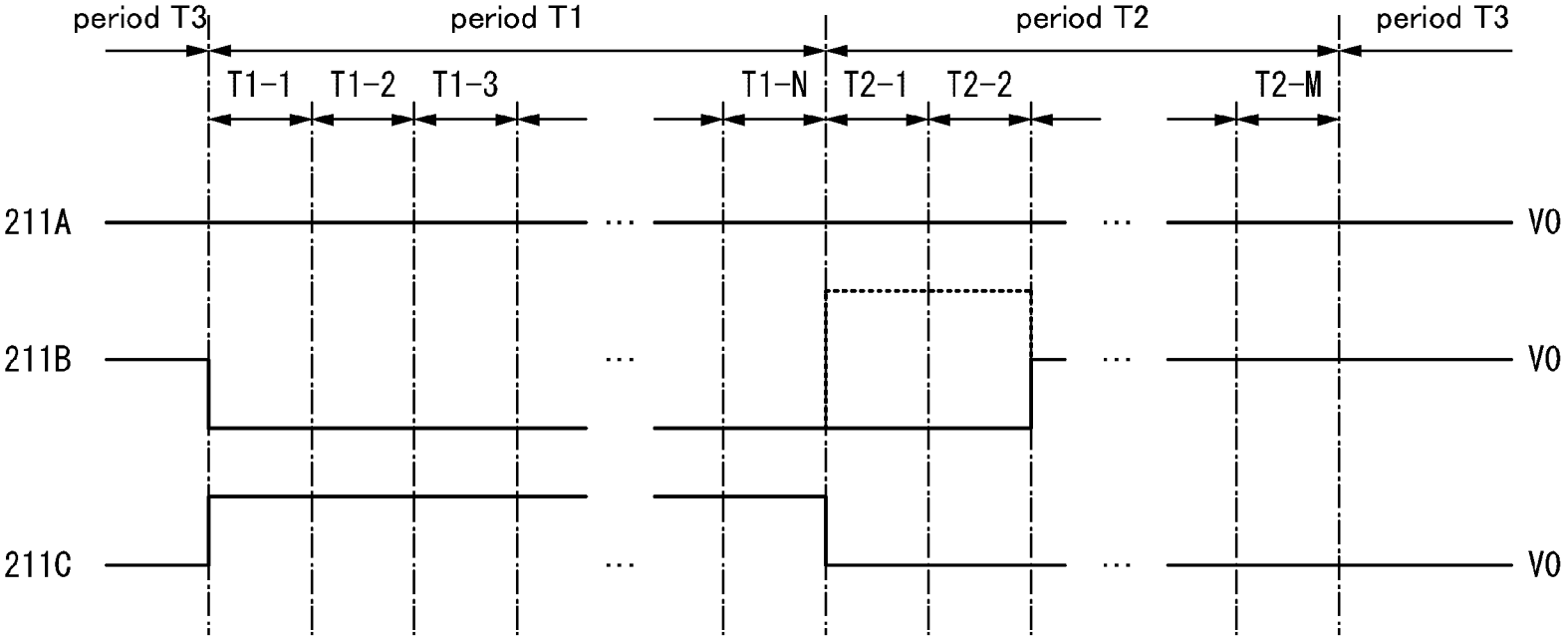
FIG. 6 is a diagram used to describe a display device according to one embodiment of the present invention.

In the timing diagram of FIG. 6, the period T1 is divided into a plurality of sub-periods (shown as periods T1-1 to T1-N (N is a natural number)), and the period T2 is divided into a plurality of sub-periods (shown as periods T2-1 to T2-M (M is a natural number)).

During the period T1, the gray level of each pixel 100 is controlled by inputting any one of an image signal whose potential is equal to the potential V0, an image signal whose potential is higher than the potential V0, and an image signal whose potential is lower than the potential V0 to each pixel 100 in each of the sub-periods (the periods T1-1 to T1-N). A combination of these signals enables a variety of gray levels of the pixel 100. Specifically, as the gray level of the pixel 100 is set higher, the number of sub-periods during which an image signal whose potential is lower than the potential V0 is input to the pixel 100 is set larger. Consequently, the time during which the potential of the pixel electrode 122 is set lower than the potential V0 becomes long, increasing the number of white particles 126 that move to the common electrode 121 side. In contrast, as the gray level of the pixel 100 is set lower, the number of sub-periods during which an image signal whose potential is higher than the potential V0 is input to the pixel 100 is set larger. Consequently, the time during which the potential of the pixel electrode 122 is set higher than the potential V0 becomes long, increasing the number of black particles 127 that move to the common electrode 121 side.

During the period T2, the gray level of each pixel 100 is controlled by inputting any one of an erase signal whose potential is equal to the potential V0, an erase signal whose potential is higher than the potential V0, and an erase signal whose potential is lower than the potential V0 to each pixel 100 in each of the sub-periods (T2-1 to T2-M). An afterimage can be erased by a combination of these signals.

During the period T3, like the driving method of the display device that has been described with reference to FIG. 5, a retention signal is input to each pixel 100 and the gray level of each pixel 100 is retained.

The image signal and the erase signal can have three values as described above. This simplifies the configuration of the signal line driver circuit 12.

Note that the movement of the particles in the period T2 is smaller than that of the particles in the period T1. Consequently, the number of sub-periods included in the period T2 can be reduced to smaller than that of sub-periods included in the period T1. Thus, the time lapse after the start of a rewrite of an image and before the retention of the image can be shortened, which reduces power consumption.

Alternatively, the amplitude voltage of an erase signal (a difference between a potential higher than the potential V0 and a potential lower than the potential V0) can be made smaller than the amplitude voltage of an image signal (a difference between a potential higher than the potential V0 and a potential lower than the potential V0). Thus, power consumption can be reduced.

Note that it is possible to assign weights to the sub-periods (the periods T1-1 to T1-N) included in the period T1. For example, when the length of the period T1-1 is t, the length of the period T1-2 is 2×t, and length of the period T1-3 is 4×t. This reduces the frequency of inputting a signal to the pixel 100, thereby reducing power consumption. It is possible to assign weights to the sub-periods (T2-1 to T2-M) included in the period T2 in the same manner.

Figure 7:
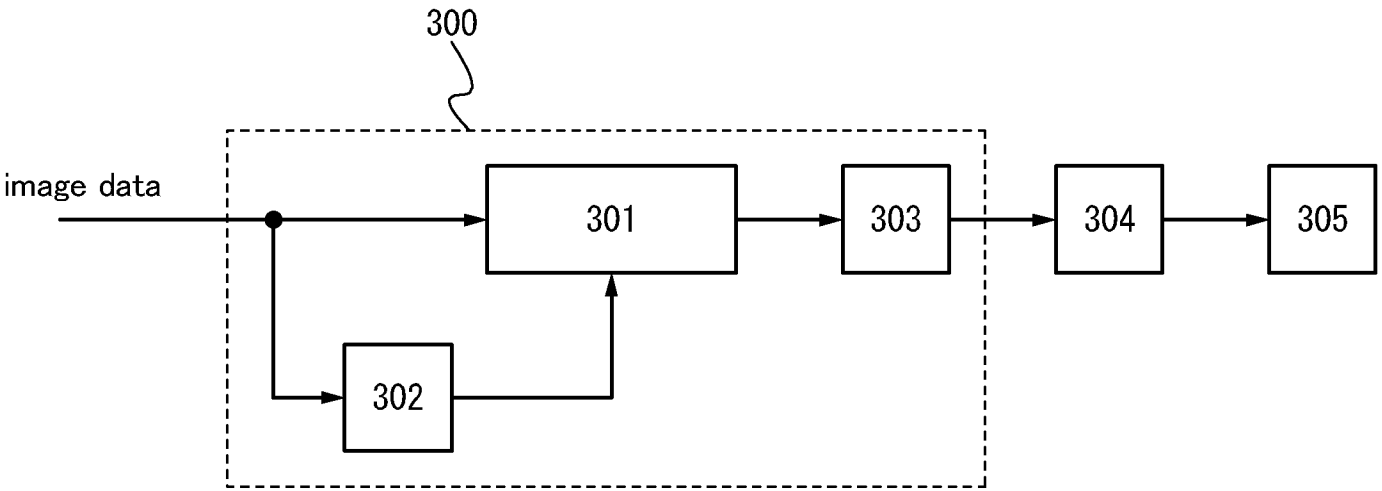
FIG. 7 is a diagram used to describe a display device according to one embodiment of the present invention.

Next, a specific example of the controller 13 will be described. FIG. 7 is an example of a block diagram showing the display device of this embodiment. A display device shown in FIG. 7 includes a controller 300, a driver circuit 304, and a display area 305. The controller 300 corresponds to the controller 13 in FIG. 1. The driver circuit 304 corresponds, for example, to the scan line driver circuit 11 or signal line driver circuit 12 shown in FIG. 1. The display area 305 corresponds to the display area 10 shown in FIG. 1. The controller 300 in FIG. 7 includes a comparator 301, a delay element 302, and a panel controller 303. Image data is input to the controller 300. Image data input to the controller 300 is input to the comparator 301 and is also input to the comparator 301 through the delay element 302. The delay element 302 holds image data, and outputs the image data to the comparator 301 when the subsequent image data is input to the controller 300. Consequently, two types of image data: an image data that has been input to the controller 300 (referred to as a new image data), and an image data that has been input to the controller 300 earlier than the new image data (referred to as an old image data) are input to the comparator 301. The comparator 301 compares the new image data with the old image data and outputs the comparison results to the panel controller 303. The panel controller 303 reads the comparison results and controls the driver circuit 304. The driver circuit 304 displays an image on the display area 305 by inputting signals to a plurality of pixels included in the display area 305.

Embodiment 1 can be implemented in appropriate combination with any of the structures described in the other embodiments.

Embodiment 2

In Embodiment 2, examples of a transistor that can be applied to a display device that is one embodiment of the present invention will be described.

FIGS. 8A to 8D each show an example of a cross-sectional structure of a transistor.

Figure 8A:
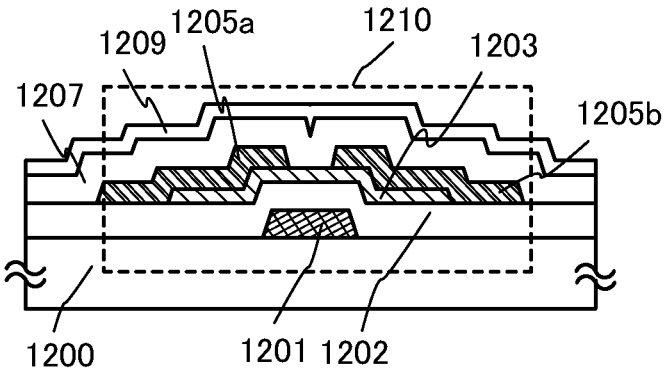
FIGS. 8A to 8D are diagrams each used to describe a display device according to one embodiment of the present invention.

A transistor 1210 shown in FIG. 8A is a bottom-gate transistor (also called an inverted staggered transistor).

The transistor 1210 includes, over a substrate 1200 having an insulating surface, a gate electrode layer 1201, a gate insulating layer 1202, a semiconductor layer 1203, a source electrode layer 1205*a*, and a drain electrode layer 1205*b*. An insulating layer 1207 is formed to cover the transistor 1210 and be in contact with the semiconductor layer 1203. A protective insulating layer 1209 is formed over the insulating layer 1207.

Figure 8B:
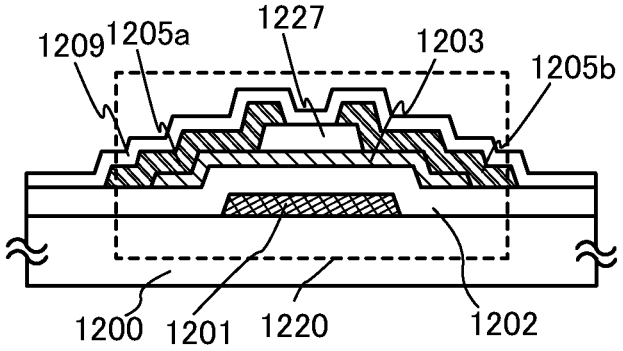

A transistor 1220 shown in FIG. 8B is a channel-protective type (channel-stop type) transistor, a kind of the bottom-gate transistor and is also called an inverted staggered transistor.

The transistor 1220 includes, over a substrate 1200 having an insulating surface, a gate electrode layer 1201, a gate insulating layer 1202, a semiconductor layer 1203, an insulating layer 1227 that is formed over a channel formation region in the semiconductor layer 1203 and functions as a channel protective layer, a source electrode layer 1205*a*, and a drain electrode layer 1205*b*. A protective insulating layer 1209 is formed to cover the transistor 1220.

Figure 8C:
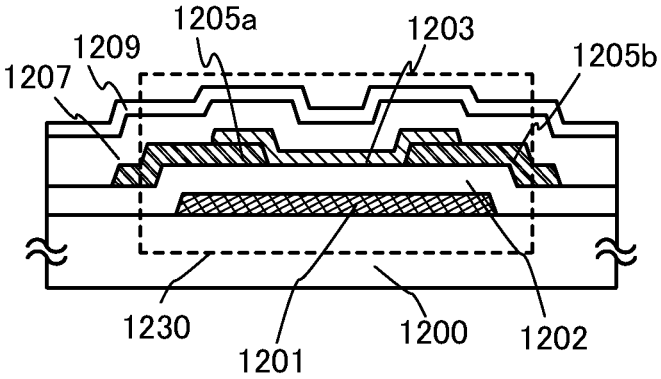

A transistor 1230 shown in FIG. 8C is a bottom-gate transistor and includes, over a substrate 1200 which is a substrate having an insulating surface, a gate electrode layer 1201, a gate insulating layer 1202, a source electrode layer 1205*a*, a drain electrode layer 1205*b*, and a semiconductor layer 1203. An insulating layer 1207 is formed to cover the transistor 1230 and be in contact with the semiconductor layer 1203. A protective insulating layer 1209 is formed over the insulating layer 1207.

In the transistor 1230, the gate insulating layer 1202 is formed in contact with the substrate 1200 and the gate electrode layer 1201. The source electrode layer 1205*a* and the drain electrode layer 1205*b* are formed in contact with the gate insulating layer 1202. The semiconductor layer 1203 is formed over the gate insulating layer 1202, the source electrode layer 1205*a*, and the drain electrode layer 1205*b*.

Figure 8D:
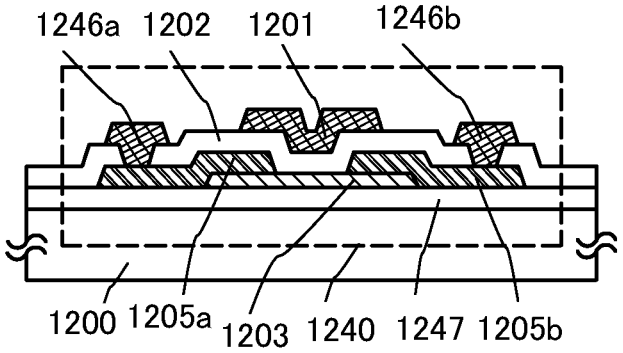

A transistor 1240 shown in FIG. 8D is a top-gate transistor. The transistor 1240 includes, over a substrate 1200 having an insulating surface, an insulating layer 1247, a semiconductor layer 1203, a source electrode layer 1205*a* and a drain electrode layer 1205*b*, a gate insulating layer 1202, and a gate electrode layer 1201. A wiring layer 1246*a* and a wiring layer 1246*b* are formed in contact with the source electrode layer 1205*a* and the drain electrode layer 1205*b*, respectively, to be electrically connected to the source electrode layer 1205*a* and the drain electrode layer 1205*b*, respectively.

In Embodiment 2, an oxide semiconductor layer is used as the semiconductor layer 1203.

The oxide semiconductor layer includes at least one element selected from In, Ga, Sn, and Zn. Examples include quaternary metal oxides such as In—Sn—Ga—Zn—O-based oxide semiconductors; ternary metal oxides such as In—Ga—Zn—O-based oxide semiconductors, In—Sn—Zn—O-based oxide semiconductors, In—Al—Zn—O-based oxide semiconductors, Sn—Ga—Zn—O-based oxide semiconductors, Al—Ga—Zn—O-based oxide semiconductors, or Sn—Al—Zn—O-based oxide semiconductors; binary metal oxides such as In—Zn—O-based oxide semiconductors, Sn—Zn—O-based oxide semiconductors, Al—Zn—O-based oxide semiconductors, Zn—Mg—O-based oxide semiconductors, Sn—Mg—O-based oxide semiconductors, In—Mg—O-based oxide semiconductors, or In—Ga—O-based oxide semiconductors; and unary metal oxides such as In—O-based oxide semiconductors, Sn—O-based oxide semiconductors, or Zn—O-based oxide semiconductors. Another example is a combination of any of the above oxide semiconductors and an element other than In, Ga, Sn, and Zn e.g., $SiO_2$.

For example, In—Ga—Zn—O-based oxide semiconductors refer to oxide semiconductors containing indium (In), gallium (Ga), and zinc (Zn), and their composition ratio does not matter.

A thin film expressed by the chemical formula of $InMO_3(ZnO)_m$ (m is greater than zero) can be used as the oxide semiconductor layer. Here, M represents one or more metal elements selected from Zn, Ga, Al, Mn, and Co. For example, M can be Ga, Ga and Al, Ga and Mn, or Ga and Co.

In the case where an In—Zn—O-based material is used as the oxide semiconductor, the composition ratio of a target used is In:Zn=50:1 to 1:2 in an atomic ratio ($In_2O_3$:ZnO=25:1 to 1:4 in a molar ratio), and preferably In:Zn=20:1 to 1:1 in an atomic ratio ($In_2O_3$:ZnO=10:1 to 1:2 in a molar ratio), and more preferably, In:Zn=15:1 to 1.5:1 in an atomic ratio ($In_2O_3$:ZnO=15:2 to 3:4 in a molar ratio). For example, the composition ratio of a target used to form an In—Zn—O-based oxide semiconductor is In:Zn:O=X:Y:Z in an atomic ratio where Z>1.5X+Y.

Alternatively, a thin film expressed by the chemical formula of $InMO_3(ZnO)_m$ (m is greater than zero and is not a natural number) can be used as the oxide semiconductor film. Here, Mrepresents one or more metal elements selected from Ga, Al, Mn, and Co. For example, M can be Ga, Ga and Al, Ga and Mn, Ga and Co, or the like.

Note that in the structure in Embodiment 2, the oxide semiconductor is an intrinsic (i-type) semiconductor or an intrinsic-type semiconductor obtained by removal of hydrogen, which is an n-type impurity, from the oxide semiconductor for high purification so that the oxide semiconductor contains an impurity other than the main component as little as possible. In other words, the oxide semiconductor in Embodiment 2 is a purified i-type (intrinsic) semiconductor or a substantially intrinsic semiconductor obtained by removing impurities such as hydrogen and water as much as possible, not by adding an impurity element. In addition, the band gap of the oxide semiconductor is 2 eV or more, preferably 2.5 eV or more, further preferably 3.0 eV or more. Thus, in the oxide semiconductor layer, the generation of carriers due to thermal excitation can be suppressed. Therefore, it is possible to suppress the increase in off-state current due to rise in operation temperature of a transistor in which a channel formation region is formed using the oxide semiconductor.

The number of carriers in the purified oxide semiconductor is very small (close to zero), and the carrier concentration is less than $1\times10^{14}/cm^3$, preferably less than $1\times10^{12}/cm^3$, further preferably less than $1\times10^{11}/cm^3$.

The number of carriers in the oxide semiconductor is so small that the off-state current of the transistor can be reduced. Specifically, the off-state current per channel width of 1 μm of the transistor in which the above-described oxide semiconductor is used for a semiconductor layer can be reduced to 10 aA/μm ($1\times10^{-17}$ A/μm) or lower, further reduced to 1 aA/μm ($1\times10^{-18}$ A/μm) or lower, and still further reduced to 10 zA/μm ($1\times10^{-20}$ A/μm). In other words, in circuit design, the oxide semiconductor can be regarded as an insulator when the transistor is off. Moreover, when the transistor is on, the current supply capability of the oxide semiconductor layer is expected to be higher than that of a semiconductor layer formed of amorphous silicon.

In each of the transistors 1210, 1220, 1230, and 1240 in which the oxide semiconductor is used for the semiconductor layer 1203, the current in an off state (the off-state current) can be lowered. Thus, the time during which an image can be retained can be made longer and the power consumption can be reduced. Alternatively, the pixel size can be reduced since storage capacitance can be omitted or reduced. Consequently, the resolution can be improved.

In addition, the withstand voltage of the transistors 1210, 1220, 1230, and 1240 in which an oxide semiconductor is used for the semiconductor layer 1203 can be increased. This means that a transistor using an oxide semiconductor serves a useful function for an electrophoretic element which needs a high drive voltage.

Although there is no particular limitation on a substrate that can be used as the substrate 1200 having an insulating surface, the substrate needs to have such heat resistance that it can withstand heat treatment to be performed later. A glass substrate made of barium borosilicate glass, aluminoborosilicate glass, or the like can be used.

In the case where the temperature of heat treatment to be performed later is high, a glass substrate whose strain point is 730° C. or more is preferably used. For a glass substrate, a glass material such as aluminosilicate glass, aluminoborosilicate glass, or barium borosilicate glass is used, for example. Note that a glass substrate containing a larger amount of barium oxide (BaO) than boron oxide ($(B_2O_3)_3$), which is practical heat-resistant glass, may be used.

Note that a substrate of an insulator, such as a ceramic substrate, a quartz substrate, or a sapphire substrate, may be used instead of the glass substrate. Alternatively, crystallized glass or the like can be used. Alternatively, a plastic substrate or the like can be used as appropriate.

In the bottom-gate transistors 1210, 1220, and 1230, an insulating film serving as a base film may be formed between the substrate and the gate electrode layer. The base film has a function of preventing diffusion of an impurity element from the substrate, and can be a single layer or stack of a silicon nitride film, a silicon oxide film, a silicon nitride oxide film, and/or a silicon oxynitride film.

The gate electrode layer 1201 can be a single layer or stack using a metal material such as molybdenum, titanium, chromium, tantalum, tungsten, aluminum, copper, neodymium, or scandium or an alloy material containing any of these materials as its main component.

A two-layer stack that may be used as the gate electrode layer 1201 is preferably any of the following: a two-layer stack of an aluminum layer overlaid by a molybdenum layer, a two-layer stack of a copper layer overlaid by a molybdenum layer, a two-layer stack of a copper layer overlaid by a titanium nitride layer or a tantalum nitride layer, and a two-layer stack of a titanium nitride layer and a molybdenum layer, for example. A three-layer stack that may be used as the gate electrode layer 1201 is preferably a stack of either a tungsten layer or a tungsten nitride layer, either an alloy layer of aluminum and silicon or an alloy layer of aluminum and titanium, and either a titanium nitride layer or a titanium layer. Note that the gate electrode layer can be formed using a light-transmitting conductive film. An example of a material for the light-transmitting conductive film is a light-transmitting conductive oxide.

The gate insulating layer 1202 can be a single layer or a stack of any of the following: a silicon oxide layer, a silicon nitride layer, a silicon oxynitride layer, a silicon nitride oxide layer, an aluminum oxide layer, an aluminum nitride layer, an aluminum oxynitride layer, an aluminum nitride oxide layer, and a hafnium oxide layer, and can be formed by plasma CVD, sputtering, or the like.

The gate insulating layer 1202 can be a stack in which a silicon nitride layer and a silicon oxide layer are stacked from the gate electrode layer side. For example, a 100-nm-thick gate insulating layer is formed in such a manner that a first gate insulating layer that is a silicon nitride layer ($SiN_y$ (y>0)) having a thickness of 50 nm to 200 nm is formed by sputtering and then a second gate insulating layer that is a silicon oxide layer ($SiO_x$ (x>0)) having a thickness of 5 nm to 300 nm is stacked over the first gate insulating layer. The thickness of the gate insulating layer 1202 may be set as appropriate depending on characteristics needed for a transistor, and may be approximately 350 nm to 400 nm.

For a conductive film used for the source electrode layer 1205*a* and the drain electrode layer 1205*b*, an element selected from Al, Cr, Cu, Ta, Ti, Mo, and W, an alloy containing any of these elements, or an alloy film containing a combination of any of these elements can be used, for example. A structure may be employed in which a high-melting-point metal layer of Cr, Ta, Ti, Mo, W, or the like is stacked on one or both of a top surface and a bottom surface of a metal layer of Al, Cu, or the like. By using an aluminum material to which an element preventing generation of hillocks and whiskers in an aluminum film, such as Si, Ti, Ta, W, Mo, Cr, Nd, Sc, or Y, is added, heat resistance can be increased.

A conductive film serving as the wiring layers 1246*a* and 1246*b* connected to the source electrode layer 1205*a* and the drain electrode layer 1205*b* can be formed using a material similar to that of the source and drain electrode layers 1205*a* and 1205*b*.

The source electrode layer 1205*a* and the drain electrode layer 1205*b* may be a single layer or a stack of two or more layers. For example, the source electrode layer 1205*a* and the drain electrode layer 1205*b* each can be any of the following: a single layer of an aluminum film containing silicon, a two-layer stack of an aluminum film overlaid by a titanium film, and a three-layer stack of a titanium film overlaid by an aluminum film overlaid by a titanium film.

The conductive film to be the source electrode layer 1205*a* and the drain electrode layer 1205*b* (including a wiring layer formed using the same layer as the source and drain electrode layers) may be formed using a conductive metal oxide. As the conductive metal oxide, indium oxide ($In_2O_3$), tin oxide ($SnO_2$), zinc oxide (ZnO), an alloy of indium oxide and tin oxide ($In_2O_3$—$SnO_2$, referred to as ITO), an alloy of indium oxide and zinc oxide ($In_2O_3$—ZnO), or any of the metal oxide materials containing silicon or silicon oxide can be used.

As the insulating layers 1207, 1227, and 1247 and the protective insulating layer 1209, an inorganic insulating film such as an oxide insulating film or a nitride insulating film is preferably used.

As the insulating layers 1207, 1227, and 1247, an inorganic insulating film such as a silicon oxide film, a silicon oxynitride film, an aluminum oxide film, or an aluminum oxynitride film can be typically used.

As the protective insulating layer 1209, an inorganic insulating film such as a silicon nitride film, an aluminum nitride film, a silicon nitride oxide film, or an aluminum nitride oxide film can be used.

A planarization insulating film may be formed over the protective insulating layer 1209 in order to reduce surface roughness due to the transistor. The planarization insulating film can be formed using a heat-resistant organic material such as polyimide, acrylic, benzocyclobutene, polyamide, or epoxy. Other than such organic materials, it is possible to use a low-dielectric constant material (a low-k material), a siloxane-based resin, PSG (phosphosilicate glass), BPSG (borophosphosilicate glass), or the like. Note that the planarization insulating film may be formed by stacking a plurality of insulating films of these materials.

Note that not only an oxide semiconductor but amorphous silicon, microcrystalline silicon, or polycrystalline silicon can be used for the semiconductor layer 1203.

Embodiment 2 can be implemented in appropriate combination with any of the structures described in the other embodiments.

Embodiment 3

Figure 9:
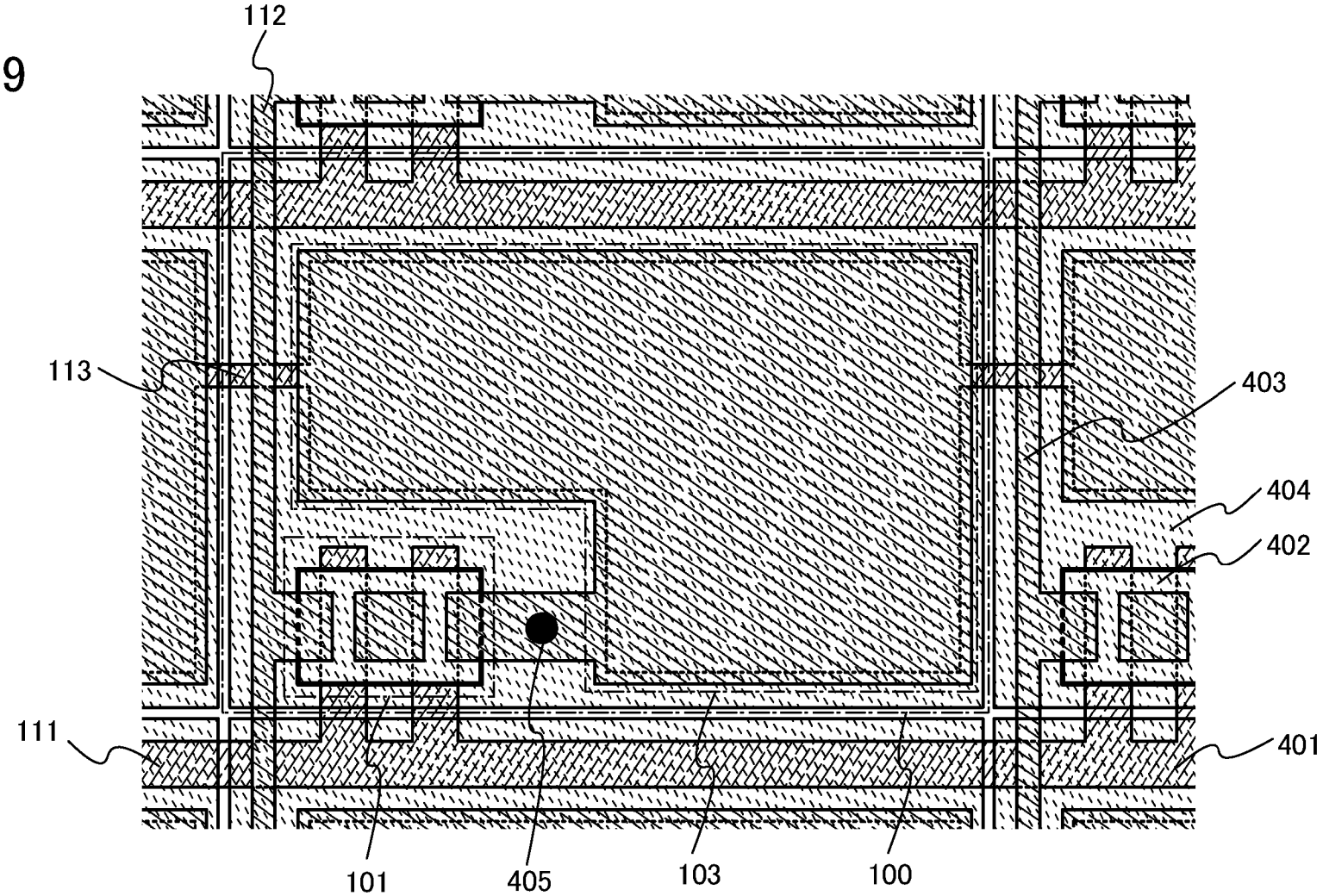
FIG. 9 is a diagram used to describe a display device according to one embodiment of the present invention.

In Embodiment 3, an example of the layout of a pixel included in a semiconductor device that is one embodiment of the present invention will be described with reference to FIG. 9.

A transistor, a capacitor, a wiring, and the like are formed using a conductive layer 401, a semiconductor layer 402, a conductive layer 403, a conductive layer 404, and a contact hole 405. Note that in addition to these layers, an insulating layer, another conductive layer, another contact hole, or the like can be formed.

The conductive layer 401 includes a portion serving as a gate electrode of a transistor; an electrode and/or a wiring of a capacitor; and the like. The semiconductor layer 402 includes a portion serving as a channel region of a transistor; and a source of a transistor and/or a drain of the transistor. The conductive layer 403 includes a portion serving as a source of a transistor; a drain of the transistor; an electrode and/or a wiring of a capacitor; and the like. The conductive layer 404 includes a portion serving as a pixel electrode. The contact hole 405 has a function of connecting the conductive layer 401 to the conductive layer 404 and/or a function of connecting the conductive layer 403 to the conductive layer 404.

The conductive layer 404 is formed to overlap with the gate line 111 and the source signal line 112. Hence, it is possible to reduce a space between the pixel electrode of one pixel (e.g., part of the conductive layer 404) and the pixel electrode of the adjacent pixel. Thus, optical aperture ratio can be increased, thereby increasing display quality.

Note that when the conductive layer 404 and the source signal line 112 overlap with each other, the potential of the conductive layer 404 becomes variable. For this reason, the capacitance of the capacitor 103 is increased, which can reduce variations in the potential of the conductive layer 404. Therefore the area of the capacitor 103 accounts preferably for 30% to 90%, and more preferably 40% to 80%, and still more preferably 50% to 70% of the area of the portion of the conductive layer 404 which portion serves as a pixel electrode.

Note that the area of the capacitor 103 is an area where the conductive layer 401 serving as one electrode of the capacitor 103 and the conductive layer 403 serving as the other electrode of the capacitor 103 overlap with each other.

Note that the conductive layer 404 can be formed to overlap with only one of the gate line 111 and the source signal line 112. Thus, noise that occurs in the conductive layer 404 can be reduced, thereby improving display quality.

Note that the conductive layer 404 is preferably formed to overlap with the gate line 111 in the previous row. Thus, variations in the potential of the conductive layer 404 due to variations in the potential of the gate line 111 can be reduced, thereby improving display quality.

The transistor 101 is a dual-gate transistor (in which two transistors are electrically connected in serial). Hence, the off-state current of the transistor 101 can be made low. This is preferable in view of the fact that display elements with memory properties need a high drive voltage in many cases.

Embodiment 3 can be implemented in appropriate combination with any of the structures described in the other embodiments.

Embodiment 4

In Embodiment 4, a structure of a display device obtained by adding a touch panel function to the display device of the above embodiments will be described with reference to FIGS. 10A and 10B.

Figure 10A:
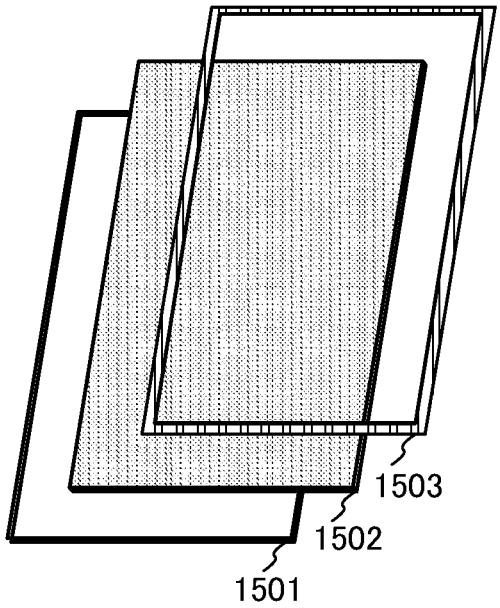
FIGS. 10A and 10B are diagrams each used to describe a display device according to one embodiment of the present invention.

FIG. 10A is a schematic diagram of a display device of this embodiment. FIG. 10A shows a structure where a touch panel unit 1502 overlaps a display panel 1501 which is the display device according to the above embodiments and they are attached together with a housing (a case) 1503. The touch panel unit 1502 can use a resistive touchscreen, a surface capacitive touchscreen, a projected capacitive touchscreen, or the like as appropriate.

As shown in FIG. 10A, the display panel 1501 and the touch panel unit 1502 are separately fabricated and overlap with each other, so that the manufacturing cost of the display device having a touch panel function can be reduced.

Figure 10B:
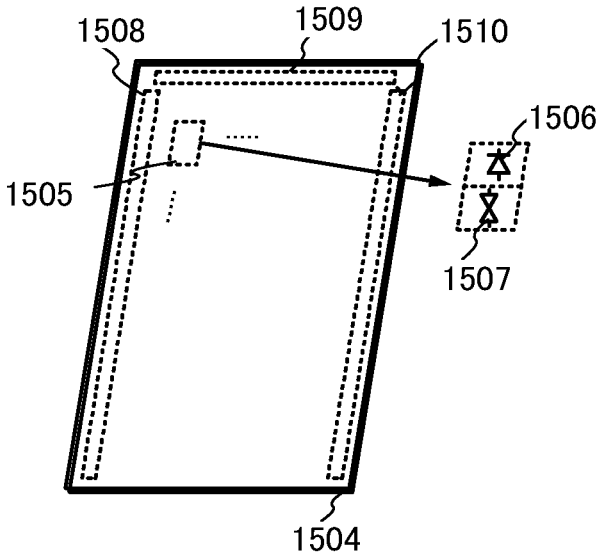

FIG. 10B shows a structure of a display device having a touch panel function which is different from that shown in FIG. 10A. A display device 1504 shown in FIG. 10B includes a plurality of pixels 1505 each including an optical sensor 1506 and a display element 1507 (e.g., an electrophoretic element or liquid crystal element). Therefore, unlike in FIG. 10A, the touch panel unit 1502 is not necessarily stacked, so that the display device can be reduced in thickness. When a gate signal line driver circuit 1508, a signal line driver circuit 1509, and an optical sensor driver circuit 1510 are formed over a substrate where the pixels 1505 are formed, the display device can be reduced in size. Note that the optical sensor 1506 may be formed using amorphous silicon or the like and overlap with a transistor using an oxide semiconductor.

According to Embodiment 4, by using a transistor having an oxide semiconductor film in a liquid crystal display device having a touch panel function, image retention characteristics at the time of displaying a still image can be improved. Moreover, it is possible to reduce deterioration of image quality due to change in gray level when a still image is displayed with a reduced refresh rate.

Embodiment 4 can be implemented in appropriate combination with any of the other embodiments.

Embodiment 5

In Embodiment 5, an example of an electronic appliance including the display device described of any of the above embodiments will be described.

Figure 11A:
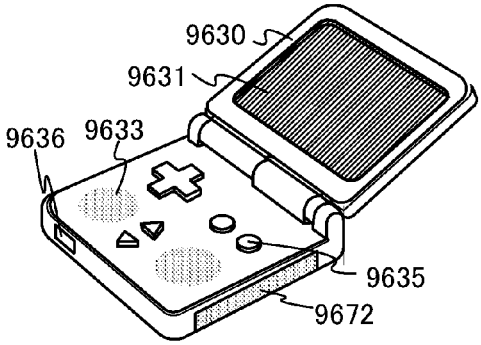
FIGS. 11A to 11D are diagrams each used to describe an electronic appliance according to one embodiment of the present invention.

FIG. 11A shows a portable game console that includes a housing 9630, a display area 9631, a speaker 9633, operation keys 9635, a connection terminal 9636, a recording medium reading portion 9672, and the like. The portable game console in FIG. 11A has a function of reading a program or data stored in the recording medium to display it on the display area, a function of sharing information with another portable game console by wireless communication, and the like. Note that the functions of the portable game console in FIG. 11A are not limited to those described above: the portable game console has various functions.

Figure 11B:
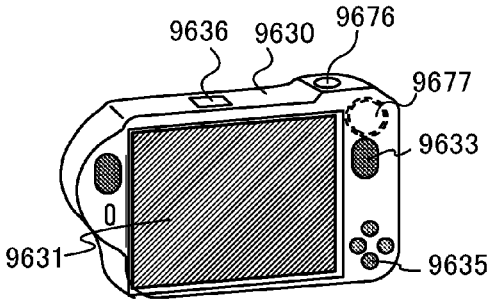

FIG. 11B shows a digital camera that includes a housing 9630, a display area 9631, a speaker 9633, operation keys 9635, a connection terminal 9636, a shutter button 9676, an image receiving portion 9677, and the like. The digital camera in FIG. 11B has a function of photographing a still image and/or a moving image, a function of automatically or manually correcting the photographed image, a function of obtaining various kinds of information from an antenna, a function of saving the photographed image or the information obtained from the antenna, a function of displaying the photographed image or the information obtained from the antenna on the display area, and the like. Note that the digital camera in FIG. 11B has a variety of functions without being limited to the above.

Figure 11C:
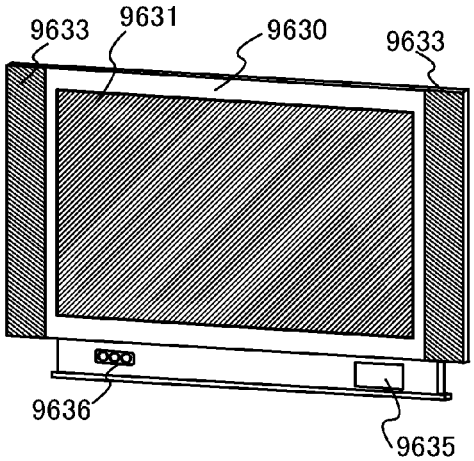

FIG. 11C shows a television set that includes a housing 9630, a display area 9631, speakers 9633, operation keys 9635, a connection terminal 9636, and the like. The television set in FIG. 11C has a function of converting an electric wave for television into an image signal, a function of converting an image signal into a signal suitable for display, a function of converting the frame frequency of an image signal, and the like. Note that the television set in FIG. 11C has a variety of functions without being limited to the above.

Figure 11D:
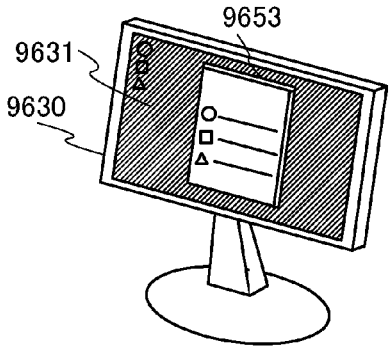

FIG. 11D shows a monitor for electronic computers (personal computers) (the monitor is also referred to as a PC monitor) that includes a housing 9630, a display area 9631, and the like. As an example, in the monitor in FIG. 11D, a window 9653 is displayed on the display area 9631. Note that FIG. 11D shows the window 9653 displayed on the display area 9631 for explanation; a symbol such as an icon or an image may be displayed. In the monitor for a personal computer, an image signal is rewritten only at the time of inputting in many cases, which is preferable to apply the method for driving a display device in the above embodiments. Note that the monitor in FIG. 11D has various functions without being limited to the above.

Figure 12A:
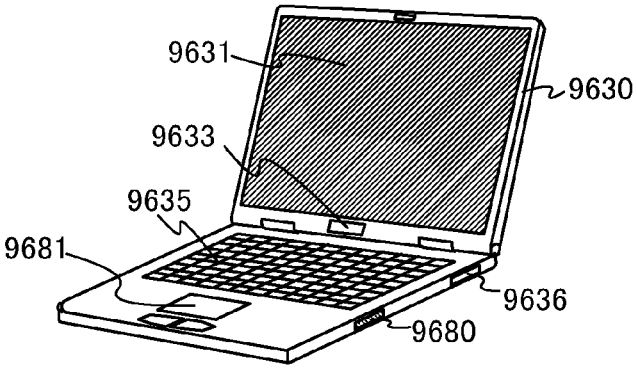
FIGS. 12A to 12D are diagrams each used to describe an electronic appliance according to one embodiment of the present invention.

FIG. 12A shows a computer that includes a housing 9630, a display area 9631, a speaker 9633, operation keys 9635, a connection terminal 9636, a pointing device 9681, an external connection port 9680, and the like. The computer in FIG. 12A has a function of displaying a variety of information (e.g., a still image, a moving image, and a text image) on the display area, a function of controlling processing by a variety of software (programs), a communication function such as wireless communication or wired communication, a function of being connected to various computer networks with the communication function, a function of transmitting or receiving a variety of data with the communication function, and the like. Note that the computer in FIG. 12A is not limited to having these functions and has a variety of functions.

Figure 12B:
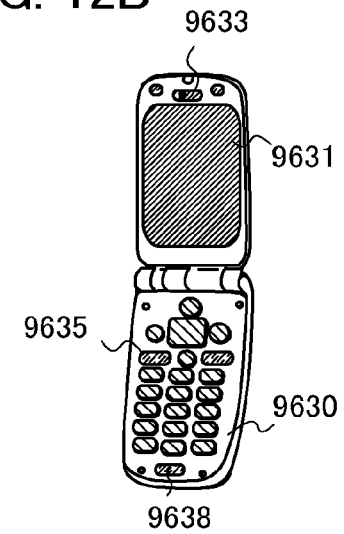

FIG. 12B shows a cellular phone that includes a housing 9630, a display area 9631, a speaker 9633, operation keys 9635, a microphone 9638, and the like. The cellular phone in FIG. 12B has a function of displaying a variety of information (e.g., a still image, a moving image, and a text image) on the display area; a function of displaying a calendar, a date, the time, or the like on the display area; a function of operating or editing the information displayed on the display area; a function of controlling processing by various kinds of software (programs); and the like. Note that the functions of the cellular phone in FIG. 12B are not limited to those described above: the cellular phone has various functions.

Figure 12C:
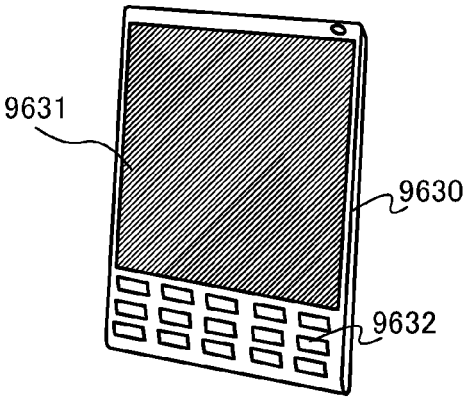
Figure 12D:
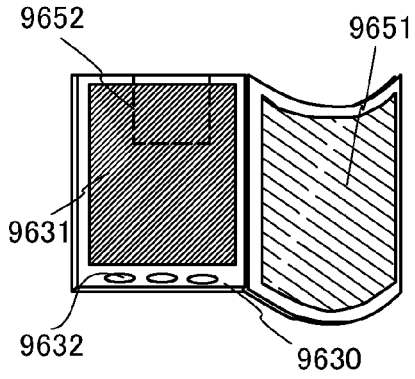

FIG. 12C shows an electronic appliance including electronic paper (also referred to as an eBook or an e-book reader) that includes a housing 9630, a display area 9631, operation keys 9632, and the like. The e-book reader in FIG. 12C has a function of displaying a variety of information (e.g., a still image, a moving image, and a text image) on the display area; a function of displaying a calendar, a date, the time, and the like on the display area; a function of operating or editing the information displayed on the display area; a function of controlling processing by various kinds of software (programs); and the like. Note that the e-book reader in FIG. 12C has a variety of functions without being limited to the above functions. FIG. 12D shows another structure of an e-book reader. The e-book reader in FIG. 12D has a structure obtained by adding a solar battery 9651 and a battery 9652 to the e-book reader in FIG. 12C. When a reflective display device is used as the display area 9631, the e-book reader is expected to be used in a comparatively bright environment, in which case the structure in FIG. 12D is preferable because the solar battery 9651 can efficiently generate power and the battery 9652 can efficiently charge power. Note that when a lithium ion battery is used as the battery 9652, an advantage such as reduction in size can be obtained.

The electronic appliances of Embodiment 5 each include the display device of Embodiment 1, so that their display quality can be improved.

Embodiment 5 can be implemented in appropriate combination with any of the structures described in the other embodiments.

This application is based on Japanese Patent Application serial no. 2010-093959 filed with Japan Patent Office on Apr. 15, 2010, the entire contents of which are hereby incorporated by reference.

What is claimed is:

1. A driving method of a display device comprising a display area including a plurality of pixels arranged in a matrix, comprising the steps of:

a first step of inputting a first signal to each of the plurality of pixels and displaying a first image on the display area;

a second step of inputting a second signal to each of the plurality of pixels and displaying a second image on the display area, the second image including an afterimage of the first image; and a third step of inputting a third signal to each of the plurality of pixels and erasing the afterimage of the first image to obtain a third image on the display area, wherein the first step and the second step are successively performed.

2. The driving method of a display device according to claim 1, wherein an amplitude voltage of the second signal is higher than an amplitude voltage of the third signal.

3. The driving method of a display device according to claim 1, wherein a time during which the second signal is held in each of the plurality of pixels is longer than a time during which the third signal is held in each of the plurality of pixels.

4. An electronic appliance comprising the display device according to claim 1 and having a communication function.

5. An electronic appliance having the display device according to claim 1 and being one selected from the group consisting of a portable game console, a digital camera, a television, a personal computer, a mobile computer, a cellular phone, and a portable electronic book.

6. A driving method of a display device comprising a display area including a plurality of pixels arranged in a matrix, comprising the steps of:

a first step of inputting a first signal to each of the plurality of pixels and displaying a first image on the display area;

a second step of inputting a second signal to each of the plurality of pixels and displaying a second image on the display area, the second image including an afterimage of the first image;

a third step of inputting a third signal to each of the plurality of pixels and erasing the afterimage of the first image to obtain a third image on the display area; and a fourth step of inputting a fourth signal to each of the plurality of pixels and retaining the third image, wherein the first step and the second step are successively performed, and wherein the third step is performed after the second step.

7. The driving method of a display device according to claim 6, wherein a potential of the fourth signal is equal to a potential of a common electrode.

8. The driving method of a display device according to claim 6, wherein an amplitude voltage of the second signal is higher than an amplitude voltage of the third signal.

9. The driving method of a display device according to claim 6, wherein a time during which the second signal is held in each of the plurality of pixels is longer than a time during which the third signal is held in each of the plurality of pixels.

10. An electronic appliance comprising the display device according to claim 6 and having a communication function.

11. An electronic appliance having the display device according to claim 6 and being one selected from the group consisting of a portable game console, a digital camera, a television, a personal computer, a mobile computer, a cellular phone, and a portable electronic book.

12. A driving method of a display device comprising a display area including a plurality of pixels arranged in a matrix, comprising the steps of:

a first step of setting a potential of a first pixel to a first potential, setting a potential of a second pixel to a second potential, setting a potential of a third pixel to a third potential, and displaying a first image on the display area; and a second step of setting the potential of the first pixel to the first potential, setting the potential of the second pixel to a fourth potential, setting the potential of the third pixel to the first potential, erasing an afterimage that appears on the display area in the first step, and displaying a second image on the display area, wherein the first potential is equal to a potential of a common electrode, wherein the second potential is lower than the potential of the common electrode, wherein the third potential is higher than the potential of the common electrode, wherein the fourth potential is lower than the potential of the common electrode, and wherein the second step is performed after the first step.

13. The driving method of a display device according to claim 12, wherein an absolute value of the fourth potential is smaller than that of the second potential.

14. The driving method of a display device according to claim 12, wherein a time during which the second potential is held in the second pixel is longer than a time during which the fourth potential is held in the second pixel.

15. An electronic appliance comprising the display device according to claim 12 and having a communication function.

16. An electronic appliance having the display device according to claim 12 and being one selected from the group consisting of a portable game console, a digital camera, a television, a personal computer, a mobile computer, a cellular phone, and a portable electronic book.

17. A driving method of a display device comprising a display area including a plurality of pixels arranged in a matrix, comprising the steps of:

a first step of setting a potential of a first pixel to a first potential, setting a potential of a second pixel to a second potential, setting a potential of a third pixel to a third potential, and displaying a first image on the display area; and a second step of setting the potential of the first pixel to the first potential, setting the potential of the second pixel to a fourth potential, setting the potential of the third pixel to the first potential, erasing an afterimage that appears on the display area in the first step, and displaying a second image on the display area, wherein the first potential is equal to a potential of a common electrode, wherein the second potential is lower than the potential of the common electrode, wherein the third potential is higher than the potential of the common electrode, wherein the fourth potential is higher than the potential of the common electrode, and wherein the second step is performed after the first step.

18. The driving method of a display device according to claim 17, wherein an absolute value of the fourth potential is smaller than that of the second potential.

19. The driving method of a display device according to claim 17, wherein a time during which the second potential is held in the second pixel is longer than a time during which the fourth potential is held in the second pixel.

20. An electronic appliance comprising the display device according to claim 17 and having a communication function.

21. An electronic appliance having the display device according to claim 17 and being one selected from the group consisting of a portable game console, a digital camera, a television, a personal computer, a mobile computer, a cellular phone, and a portable electronic book.

22. A display device comprising:

a terminal portion;

a comparator operationally connected to the terminal portion through a first electrical path;

a delay element operationally connected to the terminal portion and the comparator through a second electrical path;

a panel controller operationally connected to the comparator;

a driver circuit operationally connected to the panel controller; and a display area operationally connected to the driver circuit.

23. The display device according to claim 22, wherein the comparator having a first image data and a second image data, and wherein the second image data is input after the first image data is input.

24. The display device according to claim 22, wherein the display area comprises a thin film transistor, a capacitor, a display element and a pixel electrode.

25. The display device according to claim 22, wherein the display area comprises a dummy pixel.

26. The display device according to claim 22, wherein the display area comprises a dummy wiring.

27. An electronic appliance comprising the display device according to claim 22 and having a communication function.

28. An electronic appliance having the display device according to claim 22 and being one selected from the group consisting of a portable game console, a digital camera, a television, a personal computer, a mobile computer, a cellular phone, and a portable electronic book.

* * * * *